US011512881B2

(12) United States Patent
Kim et al.

(10) Patent No.: US 11,512,881 B2
(45) Date of Patent: Nov. 29, 2022

(54) AIR CONDITIONING APPARATUS

(71) Applicant: LG ELECTRONICS INC., Seoul (KR)

(72) Inventors: Kakjoong Kim, Seoul (KR); Chiwoo Song, Seoul (KR); Ilyoong Shin, Seoul (KR); Yongcheol Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 112 days.

(21) Appl. No.: 17/089,855

(22) Filed: Nov. 5, 2020

(65) Prior Publication Data

US 2021/0239375 A1 Aug. 5, 2021

(30) Foreign Application Priority Data

Feb. 3, 2020 (KR) ..... 10-2020-0012765

(51) Int. Cl.
*F25B 41/20* (2021.01)

(52) U.S. Cl.
CPC ..... *F25B 41/20* (2021.01)

(58) Field of Classification Search
CPC ..... F25B 41/20–28; F25B 2313/0232–02323; F25B 2400/04; F25B 2400/0401; F25B 2400/0403; F25B 2400/0409; F25B 2600/2501
See application file for complete search history.

(56) References Cited

U.S. PATENT DOCUMENTS 8,733,120 B2 * 5/2014 Morimoto ..... F25B 13/00 62/509
9,032,747 B2 * 5/2015 Yamashita ..... F24F 3/065 62/185

(Continued)

FOREIGN PATENT DOCUMENTS

EP 2 402 687 1/2012
EP 2 508 819 10/2012

(Continued)

OTHER PUBLICATIONS

European Search Report issued in Application No. 21150923.7 dated May 19, 2021.

(Continued)

*Primary Examiner* — Miguel A Diaz
(74) *Attorney, Agent, or Firm* — KED & Associates

(57) ABSTRACT

Provided is an air conditioning apparatus. The air conditioning apparatus includes an outdoor unit through which a refrigerant is circulated, an indoor unit through which water is circulated, and a heat exchange device including a heat exchanger in which the refrigerant and the water are heat-exchanged with each other. The heat exchanger includes a high-pressure guide tube, a low-pressure guide tube, a liquid guide tube, a bypass tube configured to connect a bypass branch point of the high-pressure gas tube of the outdoor unit to a bypass combination point of the liquid guide tube to bypass a high-pressure refrigerant existing in the high-pressure tube to the liquid guide tube, and a bypass valve installed in the bypass tube. The outdoor unit includes a first valve device configured to guide a refrigerant compressed in the compressor to the outdoor heat exchanger and a second valve device configured to guide the refrigerant compressed in the compressor to the high-pressure guide tube of the heat exchange device.

20 Claims, 8 Drawing Sheets

(56) References Cited

U.S. PATENT DOCUMENTS

| | | | | |
|---|---|---|---|---|
| 9,513,036 | B2 * | 12/2016 | Motomura | F25B 13/00 |
| 9,557,083 | B2 * | 1/2017 | Azuma | F24F 11/70 |
| 2012/0006050 | A1 * | 1/2012 | Takayama | F25B 13/00 165/96 |
| 2012/0118005 | A1 * | 5/2012 | Yamashita | F25B 13/00 62/513 |
| 2012/0131948 | A1 * | 5/2012 | Yamashita | F24F 3/06 62/513 |
| 2012/0198873 | A1 | 8/2012 | Yamashita et al. | |
| 2012/0198879 | A1 * | 8/2012 | Motomura | F25B 13/00 62/238.7 |
| 2012/0291472 | A1 * | 11/2012 | Morimoto | F25B 25/005 62/324.6 |
| 2014/0007607 | A1 | 1/2014 | Tamura et al. | |
| 2014/0260387 | A1 * | 9/2014 | Takenaka | F24F 3/065 62/205 |
| 2015/0176864 | A1 | 6/2015 | Yamashita et al. | |
| 2016/0209085 | A1 | 7/2016 | Kim et al. | |
| 2016/0238290 | A1 | 8/2016 | Baf et al. | |
| 2018/0259218 | A1 * | 9/2018 | Song | F24D 5/12 |
| 2018/0347868 | A1 | 12/2018 | Okano et al. | |
| 2021/0199349 | A1 * | 7/2021 | Lee | F25B 41/22 |
| 2021/0199350 | A1 * | 7/2021 | Song | F25B 49/02 |
| 2021/0231317 | A1 * | 7/2021 | Kim | F25B 25/005 |

FOREIGN PATENT DOCUMENTS

| | | | | |
|---|---|---|---|---|
| JP | 2013-170718 | | 9/2013 | |
| KR | 10-2015-0034027 | | 4/2015 | |
| KR | 10-2016-0091298 | | 8/2016 | |
| WO | WO-2011052042 | A1 * | 5/2011 | F24F 3/065 |
| WO | WO-2016194145 | A1 * | 12/2016 | F24F 11/89 |
| WO | WO 2019/064566 | | 4/2019 | |
| WO | WO-2020197052 | A1 * | 10/2020 | F24F 1/0063 |
| WO | WO-2021157820 | A1 * | 8/2021 | |

OTHER PUBLICATIONS

International Search Report dated Feb. 10, 2021 issued in International Application No. PCT/KR2020/015139.

* cited by examiner

AIR CONDITIONING APPARATUS

CROSS-REFERENCE TO RELATED APPLICATIONS

The present application claims priority under 35 U.S.C. 119 and 35 U.S.C. 365 to Korean Patent Application No. 10-2020-0012765 (filed on Feb. 3, 2020), which is hereby incorporated by reference in its entirety.

BACKGROUND

The present disclosure relates to an air conditioning apparatus.

Air conditioning apparatuses are apparatuses that maintain air in a predetermined space to the most proper state according to use and purpose thereof. In general, such an air conditioning apparatus includes a compressor, a condenser, an expansion device, and evaporator. Thus, the air conditioning apparatus has a refrigerant cycle in which compression, condensation, expansion, and evaporation processes of a refrigerant are performed to cool or heat a predetermined space.

The predetermined space may be variously provided according to a place at which the air conditioning apparatus is used. For example, the predetermined space may be a home or office space.

When the air conditioning apparatus performs a cooling operation, an outdoor heat exchanger provided in an outdoor unit may serve as a condenser, and an indoor heat exchanger provided in an indoor unit may serve as an evaporator. On the other hand, when the air conditioning apparatus performs a heating operation, the indoor heat exchanger may serve as the condenser, and the outdoor heat exchanger may serve as the evaporator.

In recent years, according to environmental regulations, there is a tendency to limit the type of refrigerant used in the air conditioning apparatus and to reduce an amount of refrigerant to be used.

To reduce an amount of refrigerant to be used, a technique for performing cooling or heating by performing heat-exchange between a refrigerant and a predetermined fluid has been proposed. For example, the predetermined fluid may include water.

An air conditioning apparatus in which cooling or heating is performed through heat-exchange between a refrigerant and water is disclosed in US Patent No. 2015-0176864 (Published Date: Jun. 25, 2015) that is a prior art document.

The air conditioning apparatus disclosed in the prior art document includes an outdoor heat exchanger which is provided with an outdoor heat exchanger and through which a refrigerant is circulated, an indoor unit through which water is circulated, and a heat exchange device provided with a plurality of heat exchangers through which the refrigerant and the water are heat-exchanged with each other.

Also, two valve devices connected to a refrigerant passage so that each of the heat exchangers operates as an evaporator or a condenser are provided in the heat exchange device. That is, in the air conditioning apparatus according to the related art, an operation mode of the heat exchanger is determined through control of the valve device.

In case of winter at which a temperature of external air is low, when a heating operation is performed, condensed water generated on a surface of an outdoor heat exchanger disposed in an outdoor space may be frozen. In this case, a smooth flow of outdoor air and heat exchange are disturbed to cause deterioration of heating performance.

Thus, to remove the condensed water or the freezing, a defrosting operation in which the heating operation is stopped during the heating operation, and a refrigeration cycle operates in a reverse cycle (i.e., a cooling operation) may be performed. As a result, a high-temperature high-pressure refrigerant passes through the outdoor heat exchanger, and the frozen water of the surface of the outdoor heat exchanger may be melted by heat of the refrigerant.

However, in the process of performing the above-described defrosting operation, a cool refrigerant (refrigerant having a temperature of zero degree or less) may be introduced into the heat exchanger in which the refrigerant and the water are heat-exchanged with each other, and thus, the water flowing through the heat exchanger may be frozen to burst.

When the heat exchanger is frozen to burst, the water and the refrigerant may be mixed due to internal leakage, and as a result, a major limitation in a system may occur.

(Patent Document 1) Publication number (Published Date): US 2015-0176864 (Jun. 25, 2015).

SUMMARY

Embodiments provide an air conditioning apparatus that is capable of preventing a heat exchanger, in which a refrigerant and water are heat-exchanged with each other, from being frozen to burst during a defrosting operation.

Embodiments also provide an air conditioning apparatus that is capable of switching a cooling operation or a heating operation and preventing corresponding heat exchangers from being frozen to burst even when only some heat exchangers of a plurality of heat exchangers are used.

Embodiments also provide an air conditioning apparatus that is capable of completely blocking a flow of a refrigerant in a corresponding heat exchanger even though the refrigerant leaks to an unused heat exchanger.

In one embodiment, an air conditioning apparatus includes an outdoor unit which includes a compressor and an outdoor heat exchanger and through which a refrigerant is circulated, an indoor unit through which water is circulated, and a heat exchanger in which the refrigerant and the water are heat-exchanged with each other.

The heat exchange device includes a high-pressure guide tube extending from a high-pressure gas tube of the outdoor unit so as to be connected to one side of the heat exchanger, a low-pressure guide tube extending from a low-pressure gas tube of the outdoor unit so as to be combined with the high-pressure guide tube, a liquid guide tube extending from a liquid tube of the outdoor unit so as to be connected to the other side of the heat exchanger, a bypass tube configured to connect a bypass branch point of the high-pressure gas tube to a bypass combination point of the liquid guide tube to bypass a high-pressure refrigerant existing in the high-pressure tube to the liquid guide tube, and a bypass valve installed in the bypass tube.

The outdoor unit further includes a first valve device configured to guide a refrigerant compressed in the compressor to the outdoor heat exchanger and a second valve device configured to guide the refrigerant compressed in the compressor to the high-pressure guide tube of the heat exchange device.

That is, embodiments may have an advantage of being able to switch a cooling operation or heating operation of the indoor unit by using the two valve devices provided in the outdoor unit.

The bypass valve may include a solenoid valve that is capable of being opened and closed.

When the outdoor heat exchanger performs a defrosting operation, the bypass valve may be opened to bypass the high-pressure refrigerant of the high-pressure gas tube to the liquid guide tube, thereby preventing the heat exchanger from being frozen to burst due to the defrosting operation.

When the indoor unit performs the cooling or heating operation, the bypass valve may be closed to restrict the bypassing of the high-pressure refrigerant of the high-pressure gas tube to the liquid guide tube.

When the indoor unit performs the cooling operation, the refrigerant compressed in the compressor may be condensed in the outdoor heat exchanger via the first valve device, and the condensed refrigerant may be evaporated in the heat exchanger of the heat exchange device.

When the indoor unit performs a heating operation, the refrigerant compressed in the compressor may be condensed in the heat exchanger of the heat exchange device via the second valve device, and the condensed refrigerant may be evaporated in the outdoor heat exchanger and suctioned into the compressor via the first valve device.

The air conditioning apparatus may further include a high-pressure valve installed in the high-pressure guide tube, the high-pressure valve being configured to be opened and closed, a low-pressure valve installed in the low-pressure guide tube, the low-pressure valve being configured to be opened and closed, and a flow valve installed in the liquid guide tube to control a flow rate of the refrigerant.

The bypass combination point may be defined at a point between the heat exchanger and the flow valve.

When the outdoor heat exchanger performs a defrosting operation, the low-pressure valve, the flow valve, and the bypass valve may be opened, and the high-pressure valve may be closed.

When the outdoor heat exchanger performs the defrosting operation, a portion of the refrigerant compressed in the compressor may flow to the outdoor heat exchanger through the first valve device, and a remaining portion of the refrigerant compressed in the compressor may flow to the bypass tube through the second valve device.

The heat exchanger may include a first heat exchanger and a second heat exchanger, the high-pressure guide tube may include a first high-pressure guide tube extending from the high-pressure gas tube of the outdoor unit so as to be connected to one side of the first heat exchanger and a second high-pressure guide tube extending from the high-pressure gas tube of the outdoor unit so as to be connected to one side of the second heat exchanger, and the liquid guide tube may include a first liquid guide tube extending from the liquid tube of the outdoor unit so as to be connected to the other side of the first heat exchanger and a second liquid guide tube extending from the liquid tube of the outdoor unit so as to be connected to the other side of the second heat exchanger.

The bypass tube may include a common tube branched from the first bypass branch point of the high-pressure gas tube, a first bypass tube branched from a second bypass branch point of the common tube so as to be connected to the first bypass combination point of the first liquid guide tube, and a second bypass tube branched from the second bypass branch point of the common tube so as to be connected to a second bypass combination point of the second liquid guide tube.

The bypass valve may be installed in the common tube. The first heat exchanger and the second heat exchanger may be prevented from being frozen to burst due to the opening of the bypass valve.

In another embodiment, an air conditioning apparatus includes: an outdoor unit which includes a compressor and an outdoor heat exchanger and through which a refrigerant is circulated; an indoor unit through which water is circulated; and a heat exchange device comprising a first heat exchanger and a second heat exchanger, in which the refrigerant and the water are heat-exchanged with each other.

The heat exchange device may include a first high-pressure guide tube extending from a high-pressure gas tube of the outdoor unit so as to be connected to one side of the first heat exchanger, a second high-pressure guide tube extending from the high-pressure gas tube of the outdoor unit so as to be connected to one side of the second heat exchanger, a first low-pressure guide tube extending from a low-pressure gas tube of the outdoor unit so as to be combined with the first high-pressure guide tube, a second low-pressure guide tube extending from the low-pressure gas tube of the outdoor unit so as to be combined with the second high-pressure guide tube, a first liquid guide tube extending from a liquid tube of the outdoor unit so as to be connected to the other side of the first heat exchanger, a second liquid guide tube extending from the liquid tube of the outdoor unit so as to be connected to the other side of the second heat exchanger, a bypass tube configured to bypass a high-pressure refrigerant of the high-pressure gas tube to the first liquid guide tube or the second liquid guide tube, and a bypass valve installed in the bypass tube.

The outdoor unit may include a first valve device configured to guide a refrigerant compressed in the compressor to the outdoor heat exchanger and a second valve device configured to the refrigerant compressed in the compressor to the first high-pressure guide tube or the second high-pressure guide tube.

The cooling operation and the heat operation may be performed at the same time by using the two valve devices provided in the outdoor unit, and the switching of the cooling operation or the heating operation may be enabled.

When only one of the first heat exchanger and the second heat exchanger is used, even if a refrigerant leak occurs in the flow valve corresponding to the heat exchanger, all a rear end of the corresponding heat exchanger may be blocked to prevent the refrigerant from flowing through the corresponding heat exchanger. Even though a small amount of refrigerant is introduced into an unused heat exchanger through the flow valve, the flow of the refrigerant may be completely blocked by closing the low-pressure valve and the high-pressure valve.

The details of one or more embodiments are set forth in the accompanying drawings and the description below. Other features will be apparent from the description and drawings, and from the claims.

DETAILED DESCRIPTION OF THE EMBODIMENTS

Figure 1:
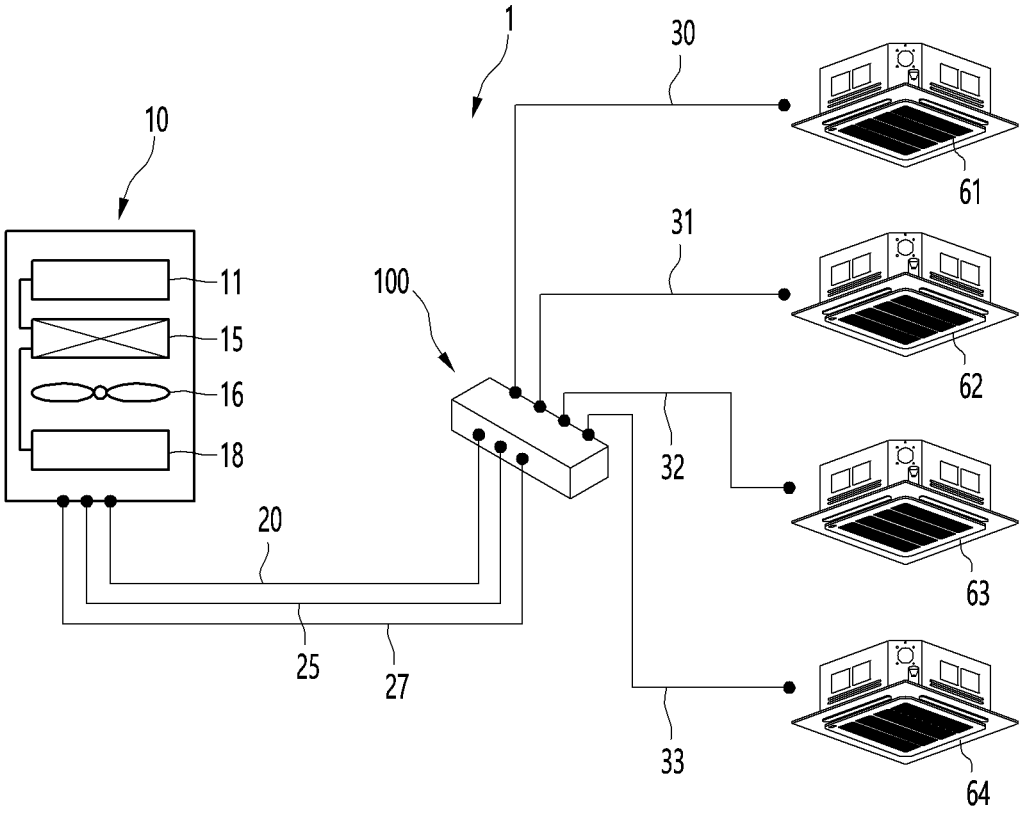
FIG. 1 is a schematic view of an air conditioning apparatus according to an embodiment.

Hereinafter, some embodiments of the present invention will be described in detail with reference to the accompanying drawings. It is noted that the same or similar components in the drawings are designated by the same reference numerals as far as possible even if they are shown in different drawings. In the following description of the present invention, a detailed description of known functions and configurations incorporated herein will be omitted to avoid making the subject matter of the present invention unclear.

In the description of the elements of the present invention, the terms first, second, A, B, (a), and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a schematic view of an air conditioning apparatus according to an embodiment.

Figure 2:
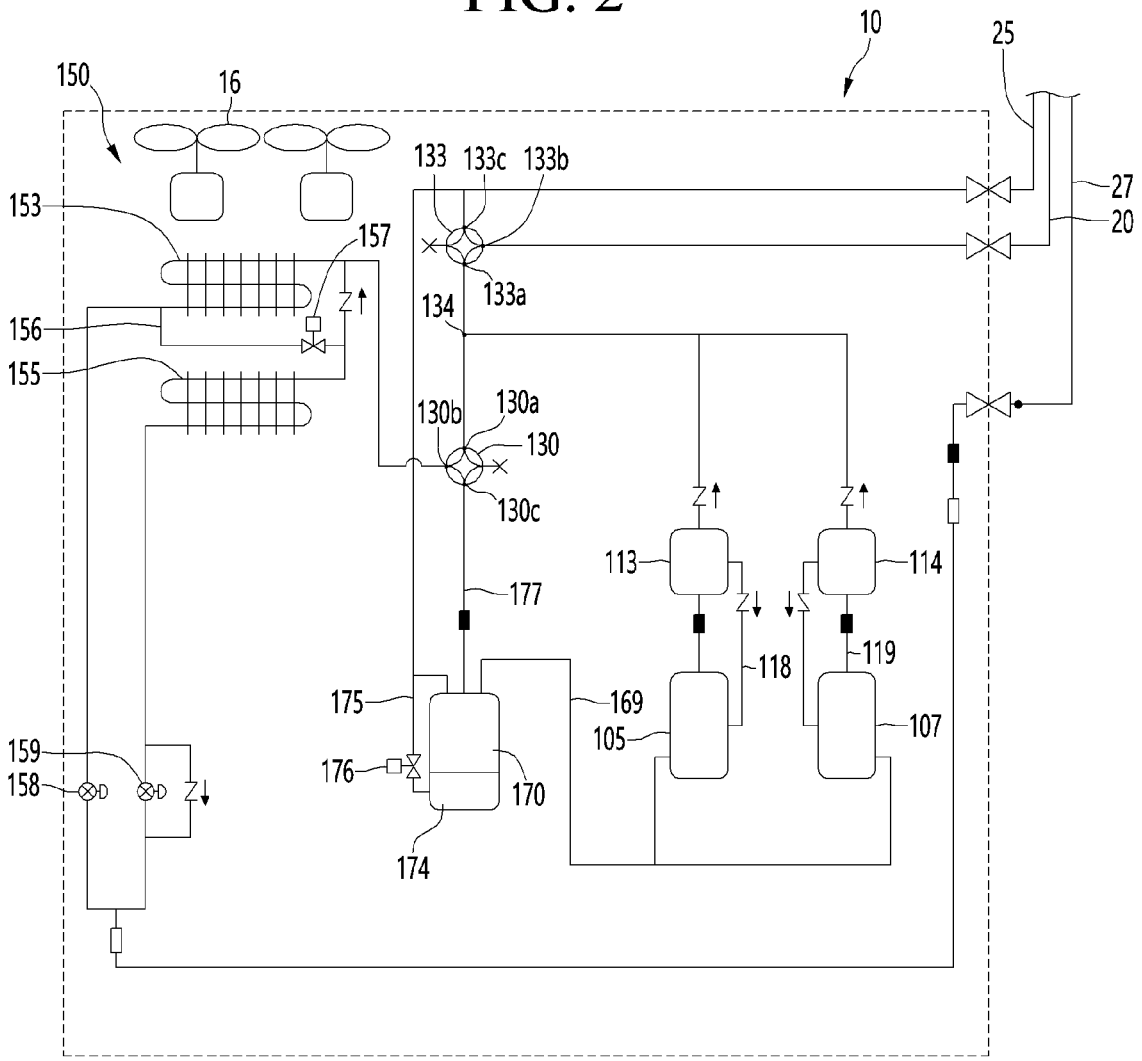
FIG. 2 is a cycle diagram illustrating constituents of an outdoor unit according to an embodiment.

Referring to FIGS. 1 and 2, an air conditioning apparatus 1 according to an embodiment may include an outdoor unit 10, an indoor unit 60, and a heat exchange device connected to the outdoor unit 10 and the indoor unit 60.

The outdoor unit 10 and the heat exchange device 100 may be fluidly connected to each other by a first fluid. For example, the first fluid may include a refrigerant.

The refrigerant may flow through a refrigerant-side passage of a heat exchanger, which is provided in the heat exchange device 100, and the outdoor unit 10.

The outdoor unit 10 may include a compressor 11 and an outdoor heat exchanger 15.

An outdoor fan 16 may be provided at one side of the outdoor heat exchanger 15 to blow external air toward the outdoor heat exchanger 15 so that heat exchange between the external air and the refrigerant of the outdoor heat exchanger 15 is performed.

The outdoor unit 10 may further include a main expansion valve 18 (EEV).

The air conditioning apparatus 1 may further include three tubes 20, 25, and 27 connecting the outdoor unit 10 to the heat exchange device 100.

The three tubes 20, 25, and 27 include a high-pressure gas tube 20 through which a high-pressure gas refrigerant flows, a low-pressure gas tube 25 through which a low-pressure gas refrigerant flows, and a liquid tube 27 through which a liquid refrigerant flows.

That is, the outdoor unit 10 and the heat exchange device 100 may have a "three tube connection structure", and the refrigerant may be circulated through the outdoor unit 10 and the heat exchange device 100 by the three connection tubes 20, 25, and 27.

The heat exchange device 100 and the indoor unit 60 may be fluidly connected to each other by a second fluid. For example, the second fluid may include water.

The water may flow through a water passage of the heat exchanger, which is provided in the heat exchange device 100, and the indoor unit 60.

Figure 3:
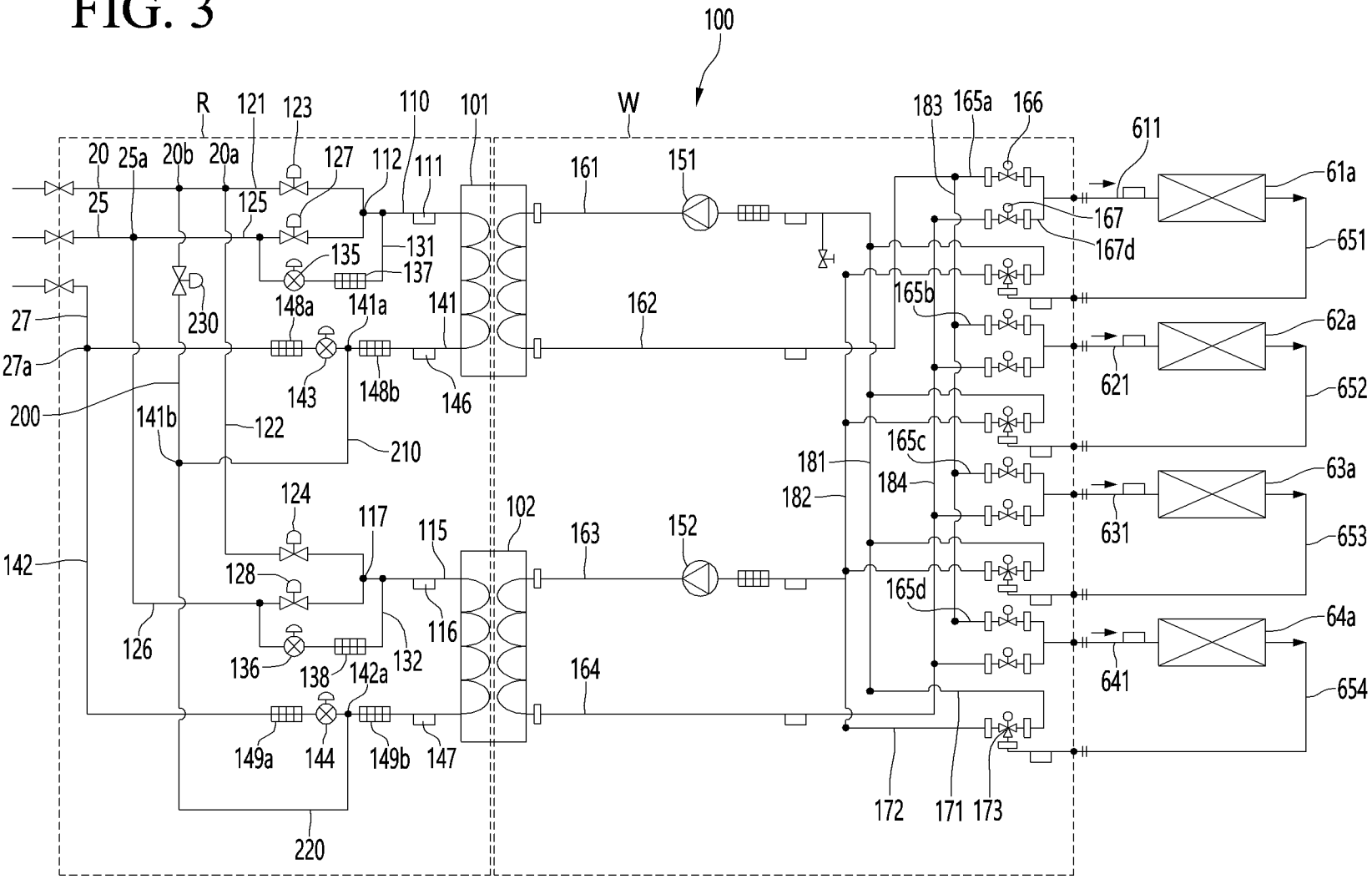
FIG. 3 is a cycle diagram illustrating constituents of a heat exchange device according to an embodiment.

The heat exchange device 100 may include a plurality of heat exchangers 101 and 102 (see FIG. 3). Each of the heat exchangers 101 and 102 may include, for example, a plate heat exchanger.

The indoor unit 60 may include a plurality of indoor units 61, 62, 63, and 64.

In this embodiment, the number of plurality of indoor units 61, 62, 63, and 64 is not limited. In FIG. 1, for example, four indoor units 61, 62, 63, and 64 are connected to the heat exchange device 100.

The plurality of indoor units 61, 62, 63, and 64 may include a first indoor unit 61, a second indoor unit 62, a third indoor unit 63, and a second indoor unit 64.

The air conditioning apparatus 1 may further include tubes 30, 31, 33, and 33 connecting the heat exchange device 100 to the indoor unit 60.

The tubes 30, 31, 32, and 33 may include first to fourth indoor unit connection tubes 30, 31, 32, and 33, which respectively connect the heat exchange device 100 to the indoor units 61, 62, 63 and 64.

The water may be circulated through the heat exchange device 100 and the indoor unit 60 via the indoor unit connection tubes 30, 31, 32, and 33. Here, the number of indoor units increases, the number of tubes connecting the heat exchange device 100 to the indoor units may also increase.

According to the above-described constituents, the refrigerant circulated through the outdoor unit 10 and the heat exchange device 100 and the water circulated through the heat exchange device 100 and the indoor unit 60 are heat-exchanged with each other through the heat exchangers 101 and 102 provided in the heat exchange device 100.

The water cooled or heated through the heat exchange may be heat-exchanged with indoor heat exchangers 61*a*, 62*a*, 63*a*, and 64*a* to perform cooling or heating in an indoor space.

In this embodiment, two or more indoor units may be connected to one heat exchanger. Alternatively, one indoor unit may be connected to one heat exchanger. In this case, the plurality of heat exchangers may be provided in the same number as the number of the plurality of indoor units.

Hereinafter, the outdoor unit 10 will be described in detail with reference to the accompanying drawings.

FIG. 2 is a cycle diagram illustrating constituents of the outdoor unit according to an embodiment.

Referring to FIG. 2, as described above, the air conditioning apparatus 1 includes the outdoor unit 10 disposed in the indoor space, the indoor unit 60 disposed in the indoor space, and the heat exchange device 100 connected to the outdoor unit 10 and the indoor unit 60. The indoor unit 60 includes the indoor heat exchangers 61*a*, 62*a*, 63*a*, and 64*a* that are heat-exchanged with air in the indoor space.

The outdoor unit 10 includes a plurality of compressors 105 and 107 and oil separators 113 and 114, which are disposed at outlet-sides of the plurality of compressors 105 and 107 to separate oil from the refrigerant discharged from the plurality of compressors 105 and 107.

The plurality of compressors 105 and 107 include a first compressor 105 and a second compressor 107, which are connected in parallel to each other. The first compressor 105 may be a main compressor, and the second compressor 107 may be a sub compressor.

The first compressor 105 may operate first, and then the second compressor 107 may additionally operate if a capacity of the first compressor 105 is insufficient, according to a capacity of a system.

Also, the oil separators 113 and 114 include a first oil separator 120 disposed on an outlet-side of the first compressor 105 and a second oil separator 122 disposed on an outlet-side of the second compressor 107.

The outdoor unit 10 includes collection passages 118 and 119 for collecting the oil from the oil separators 113 and 114 into the compressors 105 and 107.

That is, the collection passages 118 and 119 includes a first collection passage 118 extending from the first oil separator 113 to the first compressor 105 and a second collection passage 119 extending from the second oil separator 114 to the second compressor 107.

A high-pressure sensor (not shown) for detecting a discharge high-pressure of the refrigerant discharged from each of the compressor 105 and 107 is provided at an outlet-side of each of the oil separators 113 and 114.

The outdoor unit 10 includes a first valve device 130 for guiding the refrigerant compressed in the compressors 105 and 107 to the outdoor heat exchanger 150.

The first valve device 130 may be provided as a four-way valve or a three-way valve. Hereinafter, an example in which the first valve device 130 is provided as the four-way valve will be described.

The first valve device 130 includes a first port 130*a* connected to a tube extending from the compressors 105 and 107, a second port 130*b* connected to a tube extending from the outdoor heat exchanger 150, and a third port 130*c* connected to a tube extending from a gas-liquid separator 170. A fourth port of the first valve device 130 may be closed.

When the indoor unit performs the cooling operation, the refrigerant compressed in the compressors 105 and 107 may flow into the outdoor heat exchanger 150 after flowing into the first port 130*a* of the first valve device 130.

When the indoor unit performs the heating operation, the refrigerant evaporated in the outdoor heat exchanger 150 may flow into the gas-liquid separator 170 after flowing into the second port 130*b* of the first valve device 130.

Also, the outdoor unit 10 further includes a second valve device 133 for guiding the refrigerant compressed in the compressors 105 and 107 to the indoor unit 160.

The second valve device 133 may be provided as a four-way valve or a three-way valve. Hereinafter, an example in which the second valve device 133 is provided as the four-way valve will be described.

The second valve device 133 includes a first port 133*a* connected to a tube extending from the compressors 105 and 107, a second port 133*b* connected to a tube extending to the heat exchange device 100, and a third port 133*c* connected to a tube extending to the heat exchange device 100. A fourth port of the second valve device 133 may be closed.

The first port 133*a* of the second valve device 133 may be connected to the first port 130*a* of the first valve device 130. Thus, the refrigerant compressed in the compressors 105 and 107 may be introduced into the first port 130*a* of the first valve device 130 or the first port 133*a* of the second valve device 133.

Here, a branch point 134 may be defined between the first port 130*a* of the first valve device 130 and the first port 133*a* of the second valve device 133. That is, the refrigerant compressed in the compressors 105 and 107 may be branched to the first valve device 130 or the second valve device 133 through the branch point 134.

The second port 133*b* of the second valve device 133 may be connected to the high-pressure gas tube 20 extending to the heat exchange device 100.

The third port 133*c* of the second valve device 133 may be connected to the low-pressure gas tube 25 extending to the heat exchange device 100.

When the indoor unit performs the heating operation, the refrigerant compressed in the compressors 105 and 107 may be introduced into the first port 133*a* of the second valve device 133 to flow the heat exchange device 100 through the high-pressure gas tube 20.

When the indoor unit performs the cooling operation, the first port 130*a* of the second valve device 133 may be closed, and a flow of the refrigerant compressed in the compressors 105 and 107 to the heat exchange device 100 through the high-pressure gas tube 20 may be restricted.

The outdoor unit 10 includes an outdoor heat exchanger 150.

The outdoor heat exchanger 150 may be connected to the second port 130*b* of the first valve device 130.

The outdoor heat exchanger 150 includes a plurality of heat exchangers 153 and 155 and an outdoor fan 16. The plurality of heat exchangers 153 and 155 include a first heat exchanger 153 and a second heat exchanger 155, which are connected in parallel to each other.

Also, the outdoor heat exchanger 150 includes a variable passage 156 for guiding a flow of the refrigerant from an outlet-side of the first heat exchanger 153 to an inlet-side of the second heat exchanger 155. The variable passage 156 extends from an outlet-side tube of the first heat exchanger 153 to an inlet-side tube of the second heat exchanger 155.

The outdoor heat exchanger 150 includes a variable valve 157 provided in the variable passage 156 to selectively block the flow of refrigerant. The refrigerant passing through the first heat exchanger 153 may be selectively introduced into the second heat exchange 155 according to turn on/off of the variable valve 157.

In detail, when the variable valve 157 is turned on or opened, the refrigerant passing through the first heat exchanger 153 is introduced into the second heat exchanger 155 via the variable passage 156. Here, a first outdoor valve 158 provided at the outlet side of the first heat exchanger 153 may be closed.

Also, a second outdoor valve 159 may be provided at an outlet-side of the second heat exchanger 155, and the refrigerant heat-exchanged in the second heat exchanger 155 may be introduced into a supercooling heat exchanger (not shown) through the opened second outdoor valve 159.

On the other hand, when the variable valve 157 is turned off or closed, the refrigerant passing through the first heat exchanger 153 may be introduced into the supercooling heat exchanger through the first outdoor valve 158.

Here, the first and second outdoor valves 158 and 159 may be disposed in parallel to each other to correspond to the first and second heat exchangers 153 and 155.

A supercooling heat exchanger (not shown) may be disposed at an outlet-side of the outdoor heat exchanger 150. When the air conditioning apparatus 1 performs the cooling operation, the refrigerant passing through the outdoor heat exchanger 150 may be introduced into the supercooling heat exchanger.

The supercooling heat exchanger 160 may be understood as an intermediate heat exchanger in which the first refrigerant circulated through a refrigerant system and a portion (the second refrigerant) of the refrigerant are branched and then heat-exchanged with each other.

The outdoor unit 10 may further include a supercooling passage (not shown) through which the second refrigerant is branched. Also, a supercooling expansion device (not shown) for depressurizing the second refrigerant may be provided in the supercooling passage. The supercooled expansion device may include an electric expansion valve (EVV).

The outdoor unit 10 may further include the gas-liquid separator 170.

The gas-liquid separator 170 may be configured to separate a gas refrigerant from the refrigerant before the refrigerant is introduced into the compressors 105 and 107.

In detail, a gas refrigerant of the refrigerant introduced into the gas-liquid separator 170 through a low-pressure passage 177 may be suctioned into the compressors 105 and 107 through a suction passage 169. A pressure (hereinafter, referred to as a suction pressure) of the refrigerant suctioned into the compressors 105 and 107 is provided at a low pressure.

The low-pressure passage 177 may be a tube connecting the third port 130*c* of the first valve device 130 to the gas-liquid separator 170. The suction passage 169 may be a tube connecting the gas-liquid separator 170 to the compressors 105 and 107.

The outdoor unit 10 may further include a receiver 174 for storing the refrigerant.

The receiver 174 may be coupled to the gas-liquid separator 170. The receiver 174 and the gas-liquid separator 170 may be provided to be partitioned inside a refrigerant storage tank. For example, the gas-liquid separator 170 may be disposed at an upper portion of the refrigerant storage tank, and the receiver 174 may be disposed at a lower portion of the refrigerant storage tank.

A receiver outlet tube 175 is connected to the receiver 174.

The receiver outlet tube 175 may extend to the gas-liquid separator 170. At least a portion of the refrigerant stored in the receiver 174 may be introduced into the gas-liquid separator 170 through the receiver outlet tube 175.

A receiver outlet valve 176 for adjusting an amount of refrigerant discharged from the receiver 174 is provided in the receiver outlet tube 175. An amount of refrigerant introduced into the gas-liquid separator 170 may be adjusted according to turn on/off or an opening degree of the receiver outlet valve 176.

Hereinafter, the heat exchange device 100 will be described in detail with reference to the drawings.

FIG. 3 is a cycle diagram illustrating constituents of the heat exchange device according to an embodiment.

Referring to FIG. 3, the heat exchange device 100 may include a first heat exchanger 101 and a second heat exchanger 102, which are fluidly connected to each of the indoor units 61, 62, 63, and 64, respectively.

The first heat exchanger 101 and the second heat exchanger 102 may have the same structure.

Each of the heat exchangers 101 and 102 may include, for example, a plate heat exchanger and may be configured so that the water passage and the refrigerant passage are alternately stacked.

Each of the heat exchangers 101 and 102 may include the refrigerant passage and the water passage.

Each of the refrigerant passages may be fluidly connected to the outdoor unit 10, and the refrigerant discharged from the outdoor unit 10 may be introduced into the refrigerant passage, or the refrigerant passing through the refrigerant passage may be introduced into the outdoor unit 10.

Each of the water passages may be connected to each of the indoor units 61, 62, 63, and 64, the water discharged from each of the indoor units 61, 62, 63, and 64 may be introduced into the water passage, and the water passing through the water passage may be introduced into each of the indoor units 61, 62, 63, and 64.

The heat exchange device 100 may include a switching unit R for adjusting a flow direction and flow rate of the refrigerant introduced into and discharged from the first heat exchanger 101 and the second heat exchanger 102.

In detail, the switching unit R includes refrigerant tubes 110 and 115 coupled to one sides of the heat exchangers 101 and 102 and liquid guide tubes 141 and 142 coupled to the other sides of the heat exchanger 101 and 102.

The refrigerant tubes 110 and 115 and the liquid guide tubes 141 and 142 may be connected to a refrigerant passage provided in each of the heat exchangers 101 and 102 so as to be heat-exchanged with the water.

The refrigerant tubes 110 and 115 and the liquid guide tubes 141 and 142 may guide the refrigerant to pass through the heat exchangers 101 and 102.

In detail, the refrigerant tubes 110 and 115 may include a first refrigerant tube 110 coupled to one side of the first heat exchanger 101 and a second refrigerant tube 115 coupled to one side of the second heat exchanger 102.

The liquid guide tubes 141 and 142 may include a first liquid guide tube 141 coupled to the other side of the first heat exchanger 101 and a second liquid guide tube 142 coupled to the other side of the second heat exchanger 102.

For example, the refrigerant may be circulated through the first heat exchanger 101 by the first refrigerant tube 110 and the first liquid guide tube 141. Also, the refrigerant may be circulated through the second heat exchanger 102 by the second refrigerant tube 115 and the second liquid guide tube 142.

The liquid guide tubes 141 and 142 may be connected to the liquid tube 27.

In detail, the liquid tube 27 may define a liquid tube branch point 27*a* branching into the first liquid guide tube 141 and the second liquid guide tube 142.

That is, the first liquid guide tube 141 may extend from the liquid tube branch point 27*a* to the first heat exchanger 101, and the second liquid guide tube 142 may extend from the liquid tube branch point 27*a* to the second heat exchanger 102.

The air conditioning apparatus 1 may further include gas refrigerant sensors 111 and 116 installed in the refrigerant tubes 110 and 115 and liquid refrigerant sensors 146 and 147 installed in the liquid guide tubes 141 and 142.

The gas refrigerant sensors 111 and 116 and the liquid refrigerant sensors 146 and 147 may be referred to as "refrigerant sensors".

Also, the refrigerant sensors may detect a state of the refrigerant flowing through the refrigerant tubes 110 and 115 and the liquid guide tubes 141 and 142. For example, the refrigerant sensors may detect a temperature and pressure of the refrigerant.

The gas refrigerant sensors 111 and 116 may include a first gas refrigerant sensor 111 installed in the first refrigerant tube 110 and a second gas refrigerant sensor 116 installed in the second refrigerant tube 115.

The liquid refrigerant sensors 146 and 147 may include a first liquid refrigerant sensor 146 installed in the first liquid guide tube 141 and a second liquid refrigerant sensor 147 installed in the second liquid guide tube 142.

The air conditioning apparatus 1 may further include flow valves 143 and 144 installed in the liquid guide tubes 141 and 142.

Each of the flow valves 143 and 144 may adjust a flow rate of the refrigerant by adjusting an opening degree thereof. Each of the flow valves 143 and 144 may include an electronic expansion valve (EEV). Also, each of the flow valves 143 and 144 may be adjusted in opening degree to adjust a pressure of the refrigerant passing therethrough.

The electronic expansion valve may reduce a pressure of the refrigerant passing through the expansion valves 143 and 144 by adjusting the opening degree. For example, when the electronic expansion valves 143 and 144 are fully opened (full-open state), the refrigerant may pass without decompression, and when the opening degree of each of the expansion valves 143 and 144 is reduced, the refrigerant may be depressurized. A degree of decompression of the refrigerant may increase as the degree of opening decreases.

The flow valves 143 and 144 may include a first flow valve 143 installed in the first liquid guide tube 141 and a second flow valve 144 installed in the second liquid guide tube 142.

The air conditioning apparatus 1 may further include strainers 148*a*, 148*b*, 149*a*, and 149*b* installed on both sides of the flow valves 143 and 144.

The strainers 148*a*, 148*b*, 149*a*, and 149*b* are devices for filtering wastes of the refrigerant flowing through the liquid guide tubes 141 and 142. For example, the strainers 148*a*, 148*b*, 149*a*, and 149*b* may be provided as a metal mesh.

The strainers 148*a*, 148*b*, 149*a*, and 149*b* may include a first strainer 148*a* and 148*b* installed on the first liquid guide tube 141 and second strainer 149*a* and 149*b* installed on the second liquid guide tube 142.

The first strainers 148*a* and 148*b* may include a strainer 148*a* installed at one side of the first flow valve 143 and a strainer 148*b* installed at the other side of the first flow valve 143. As a result, even if the flow direction of the refrigerant is switched, the wastes may be filtered.

Likewise, the second strainers 149*a* and 149*b* may include a strainer 149*a* installed at one side of the second flow valve 144 and a strainer 149*b* installed at the other side of the second flow valve 144.

The refrigerant tubes 110 and 115 may be connected to the high-pressure gas tube 20 and the low-pressure gas tube 25. Also, the liquid guide tubes 141 and 142 may be connected to the liquid tube 27.

In detail, the refrigerant tubes 110 and 115 may define refrigerant branch points 112 and 117 at one end thereof, respectively. Also, the refrigerant branch points 112 and 117 may be connected so that the high-pressure gas tube 20 and the low-pressure gas tube 25 are combined with each other.

That is, one ends of the refrigerant tubes 110 and 115 have refrigerant branch points 112 and 117, and the other ends of the refrigerant tubes 110 and 115 may be coupled to the refrigerant passages of the heat exchangers 101 and 102.

The switching unit R may further include high-pressure guide tubes 121 and 122 extending from the high-pressure gas tube 20 to the refrigerant tubes 110 and 115.

That is, the high-pressure guide tubes 121 and 122 may connect the high-pressure gas tube 20 to the refrigerant tubes 110 and 115.

The high-pressure guide tubes 121 and 122 may be branched from the high-pressure branch point 20*a* of the high-pressure gas tube 20 to extend to the refrigerant tubes 110 and 115.

In detail, the high-pressure guide tubes 121 and 122 may include a first high-pressure guide tube 121 extending from the high-pressure branch point 20*a* to the first refrigerant tube 110 and a second refrigerant guide tube 122 extending from the second high-pressure branch point 20*a* to the second refrigerant tube 115.

The first high-pressure guide tube 121 may be connected to the first refrigerant branch point 112, and the second high-pressure guide tube 122 may be connected to the second refrigerant branch point 117.

That is, the first high-pressure guide tube 121 may extend from the high-pressure branch point 20*a* to the first refrigerant branch point 112, and the second high-pressure guide tube 122 may extend from the high-pressure branch point 20*a* to the second refrigerant branch point 117.

The air conditioning apparatus 1 may further include high-pressure valves 123 and 124 installed in the high-pressure guide tubes 121 and 122.

Each of the high-pressure valves 123 and 124 may restrict a flow of the refrigerant to each of the high-pressure guide tubes 121 and 122 through an opening and closing operation thereof.

The high-pressure valves 123 and 124 may include a first high-pressure valve 123 installed in the first high-pressure guide tube 121 and a second high-pressure valve 124 installed in the second high-pressure guide tube 122.

The first high-pressure valve 123 may be installed between the high-pressure branch point 20*a* and the first refrigerant branch point 112.

The second high-pressure valve 124 may be installed between the high-pressure branch point 20*a* and the second refrigerant branch point 117.

The first high-pressure valve 123 may control a flow of the refrigerant between the high-pressure gas tube 20 and the first refrigerant tube 110. Also, the second high-pressure valve 124 may control a flow of the refrigerant between the high-pressure gas tube 20 and the second refrigerant tube 115.

The switching unit R may further include low-pressure guide tubes 125 and 126 extending from the low-pressure tube 25 to the refrigerant tubes 110 and 115.

That is, the low-pressure guide tubes 125 and 126 may connect the low-pressure tube 25 to the refrigerant tubes 110 and 115.

The low-pressure guide tubes 125 and 126 may be branched from the low-pressure branch point 25*a* of the low-pressure gas tube 25 to extend to the refrigerant tubes 110 and 115.

In detail, the low-pressure guide tube 125 and 126 may include a first low-pressure guide tube 125 extending from the low-pressure branch point 25*a* to the first refrigerant tube 110 and a second low-pressure guide tube 126 extending from the low-pressure branch point 25*a* to the second low-pressure refrigerant tube 115.

The first low-pressure guide tube 125 may be connected to the first refrigerant branch point 112, and the second low-pressure guide tube 126 may be connected to the second refrigerant branch point 117.

That is, the first low-pressure guide tube 125 may extend from the low-pressure branch point 25*a* to the first refrigerant branch point 112, and the second low-pressure guide tube 126 may extend from the low-pressure branch point 25*a* to the second refrigerant branch point 117. Thus, the high-pressure guide tubes 121 and 122 and the low-pressure guide tubes 125 and 126 may be combined with each other at the refrigerant branch points 115 and 117.

The air conditioning apparatus 1 may further include low-pressure valves 127 and 128 installed in the low-pressure guide tubes 125 and 126.

Each of the low-pressure valves 127 and 128 may restrict a flow of the refrigerant to each of the low-pressure guide tubes 125 and 126 through an opening and closing operation thereof.

The low-pressure valves 127 and 128 may include a first low-pressure valve 127 installed in the first low-pressure guide tube 125 and a second low-pressure valve 128 installed in the second low-pressure guide tube 126.

The first low-pressure valve 127 may be installed between a point at which the first refrigerant branch point 112 and a first pressure equalization tube 131 to be described later are connected to each other.

The second low-pressure valve 128 may be installed between a point at which the second refrigerant branch point 117 and a second pressure equalization tube 132 to be described later are connected to each other.

The switching unit R may further include pressure equalization tubes 131 and 132 branching from the first refrigerant tube 110 to extend to the low-pressure guide tubes 125 and 126.

The pressure equalization tubes 131 and 132 may include a first pressure equalization tube 131 branched from one point of the first refrigerant tube 110 to extend to the first low-pressure guide tube 125 and a second pressure equalization tube 132 branching from one point of the second refrigerant tube 115 to extend to the second low-pressure guide tube 126.

Points at which the pressure equalization tubes 131 and 132 and the low-pressure guide tubes 125 and 126 are connected to each other may be disposed between the low-pressure branch point 25*a* and the low-pressure valves 127 and 128, respectively.

That is, the first pressure equalization tube 131 may be branched from the first refrigerant tube 110 to extend to the first low-pressure guide tube 125 disposed between the low-pressure branch point 25*a* and the first low-pressure valve 127.

Similarly, the second pressure equalization tube 132 may be branched from the second refrigerant tube 115 to extend to the second low-pressure guide tube 126 disposed between the low-pressure branch point 25*a* and the second low-pressure valve 128.

The air conditioning apparatus 1 may further include pressure equalization valves 135 and 136 and pressure equalization strainers 137 and 138, which are installed in the pressure equalization tubes 131 and 132.

The pressure equalization valves 135 and 136 may be adjusted in opening degree to bypass the refrigerant in the refrigerant tubes 110 and 115 to the low-pressure guide tubes 125 and 126.

Each of the pressure equalization valves 135 and 136 may include an electronic expansion valve (EEV).

The pressure equalization valves 135 and 136 may include a first pressure equalization valve 135 installed in the first pressure equalization tube 131 and a second pressure equalization valve 136 installed in the second pressure equalization tube 132.

The pressure equalization strainers 137 and 138 may include a first pressure equalization strainer 137 installed in the first pressure equalization tube 131 and a second pressure equalization strainer 138 installed in the second pressure equalization tube 132.

The pressure equalization strainers 137 and 138 may be disposed between the pressure equalization valves 135 and 136 and the refrigerant tubes 110 and 115. Thus, the wastes of the refrigerant flowing from the refrigerant tubes 110 and 115 to the pressure equalization valves 135 and 136 may be filtered, or foreign substances may be prevented from passing therethrough.

The pressure equalization tubes 131 and 132 and the pressure equalization valves 135 and 136 may be referred to as a "pressure equalization circuit".

The pressure equalization circuit may operate to reduce a pressure difference between the high-pressure refrigerant and the low-pressure refrigerant in the refrigerant tubes 110 and 115 when an operation mode of the heat exchangers 101 and 102 is switched.

Here, the operation mode of the heat exchangers 101 and 102 may include a condenser mode operating as the condenser and an evaporator mode operating as the evaporator.

For example, when the heat exchangers 101 and 102 switch the operation mode from the condenser to the evaporator, the high-pressure valves 123 and 124 may be closed, and the low-pressure valves 127 and 128 may be opened.

The adjustment of the opening degree of each of the pressure equalization valves 135 and 136 may be performed gradually as the time elapses. Thus, the opening degree of the high-pressure valves 123 and 124 and the low-pressure valve 127 may also be controlled.

The pressures of the refrigerant tubes 110 and 115 may be lowered by the refrigerant introduced into the pressure equalization tubes 131 and 132.

Thus, the pressure equalization valves 135 and 136 may be opened to reduce the pressure difference between the low-pressure guide tubes 125 and 126 and the refrigerant tubes 110 and 115 within a predetermined range, thereby realizing pressure equalization.

Also, the pressure equalization valves 135 and 136 may be closed again. Thus, the low-pressure refrigerant passing through the heat exchangers 101 and 102 may flow to the low-pressure guide tubes 125 and 126 without a large pressure difference.

As a result, since the heat exchangers 101 and 102 are stably switched to serve as the evaporator, noise generation and durability limitations caused by the above-described pressure difference may be solved.

The air conditioning apparatus 1 may further include bypass tubes 200, 210, 220 connecting the high-pressure gas tube 20 to the liquid tube 27.

The bypass tube 200, 210, and 220 may bypass the high-pressure refrigerant flowing through the high-pressure gas tube 20 to the heat exchangers 101 and 102 to prevent the heat exchangers 101 and 102 from being frozen to burst.

For example, when a temperature of external air is very low, or when the heating operation of the indoor unit is performed, frost may be generated on the outdoor heat exchanger 150 provided in the outdoor space. Since heat exchange performance is reduced when the frost is generated, the air conditioning apparatus 1 may perform a defrosting operation at regular time intervals.

Here, the "defrosting operation" may be understood as operating in the cooling cycle of the indoor unit for a predetermined time so as to remove the frost generated on the outdoor heat exchanger 150 during the heating operation of the indoor unit.

For the defrosting operation, the heat exchangers 101 and 102 may operate as the evaporators, and simultaneously, when a cold refrigerant (refrigerant having a temperature of about 0 degrees or less) flows to the heat exchangers 101 and 102, the heat exchangers 101 and 102 may be frozen to burst.

When the heat exchangers 101 and 102 are frozen to burst, the water and the refrigerant may be mixed due to internal leakage, and as a result, a major limitation in the system may occur.

Thus, in this embodiment, to prevent the heat exchanger from being frozen to burst, the high-temperature refrigerant may be injected into the heat exchangers 101 and 102 through the bypass tubes 200, 210 and 220 during the defrosting operation.

In detail, the bypass tubes 200, 210, and 220 may include a common tube 200 branching from one point of the high-pressure gas tube 20, a first bypass tube 210 branched from the common tube 200 and connected to the first liquid guide tube 141, and a second bypass tube 220 branched from the common tube 200 and connected to the second liquid guide tube 142.

The common tube 200 may be branched from a first bypass branch point 20*b* of the high-pressure gas tube 20 to extend. The high-pressure refrigerant of the high-pressure gas tube 20 may flow through the common tube 200.

The first bypass tube 210 may be branched from a second bypass branch point 141*b* of the common tube 200 to extend to a first bypass combination point 141*a* of the first liquid guide tube 141.

The first bypass combination point 141*a* may be defined at a point between the first flow valve 143 and the first heat exchanger 101 in the first liquid guide tube 141.

Specifically, the first bypass combination point 141*a* may be defined at a point between the first flow valve 143 and the first strainer 148*b*.

Alternatively, the first bypass combination point 141*a* may be defined at a point between the first flow valve 143 and the first liquid refrigerant sensor 146.

The second bypass tube 220 may be branched from the second bypass branch point 141*b* of the common tube 200 and connected to the second bypass combination point 142*a* of the second liquid guide tube 141.

The second bypass combination point 142*a* may be defined at a point between the second flow valve 144 and the second heat exchanger 102 in the second liquid guide tube 142.

Specifically, the second bypass combination point 142*a* may be defined at a point corresponding to a point between the second flow valve 144 and the second strainer 149*b*.

Alternatively, the second bypass combination point 142*a* may be defined at a point corresponding to a point between the second flow valve 144 and the second liquid refrigerant sensor 147.

The air conditioning apparatus 1 may further include a bypass valve 230 installed in each of the bypass tubes 200, 210, and 220.

The bypass valve 230 may be opened or closed to control movement of the refrigerant in the bypass tubes 200, 210, and 220. For example, the bypass valve 230 may include a solenoid valve capable of being opened and closed.

Specifically, the bypass valve 230 may be installed in the common tube 200. For example, during the defrosting operation, when the bypass valve 230 is opened, the high-pressure refrigerant flowing through the high-pressure gas tube 20 may pass through the bypass tubes 200, 210, and 220 and then be provided to the first heat exchanger 101 and the second heat exchanger 102.

According to this configuration, both the first heat exchanger 101 and the second heat exchanger 102 may be effectively prevented from being frozen to burst through the control of the one bypass valve 230.

The air conditioning apparatus 1 may further include a controller (not shown).

The controller (not shown) may control operations of the high-pressure valves 123 and 124, the low-pressure valves 127 and 128, the pressure equalization valves 135 and 136, and the flow valves 143 and 144, which are described so that the operation mode of the heat exchangers 101 and 102 are switched according to the heating or cooling mode required in the plurality of indoor units 61, 62, 63, and 64.

Also, the controller may open the bypass valve 230 according to whether the defrosting operation is performed.

The heat exchange device 100 may further include heat exchanger inlet tubes 161 and 163 connected to the water passages of the heat exchanger 101 and 102 and heat exchanger discharge outlet tubes 162 and 164.

The heat exchanger inlet tubes 161 and 163 include a first heat exchanger inlet tube 161 connected to an inlet of the water passage of the first heat exchanger 101 and a second heat exchanger inlet tube 163 to be connected to an inlet of the water passage of the second heat exchanger 102.

The heat exchanger outlet tubes 162 and 164 include a first heat exchanger outlet tube 162 connected to an outlet of the water passage of the first heat exchanger 101 and a second heat exchanger outlet tube 164 to be connected to an outlet of the water passage of the second heat exchanger 102.

A first pump 151 may be provided in the first heat exchanger inlet tube 161, and a second pump 152 may be provided in the second heat exchanger inlet tube 163.

A first combination tube 181 may be connected to the first heat exchanger inlet tube 161. A second combination tube 182 may be connected to the second heat exchanger inlet tube 163.

A third combination tube 183 may be connected to the first heat exchanger outlet tube 162. A fourth combination tube 184 may be connected to the second heat exchanger outlet tube 164.

A first water outlet tube 171 through which water discharged from each of the indoor heat exchangers 61*a*, 62*a*, 63*a*, and 64*a* flows may be connected to the first combination tube 181.

A second water outlet pipe 172 through which water discharged from the indoor heat exchangers 61*a*, 62*a*, 63*a*, and 64*a* flows may be connected to the second combination tube 182.

The first water outlet tube 171 and the second water outlet tube 172 may be disposed in parallel to each other and be connected to the common water outlet tubes 651, 652, 653, and 654 communicating with the indoor heat exchangers 61*a*, 62*a*, 63*a*, and 64*a*.

The first water outlet tube 171, the second water outlet tube 172, and each of the common water outlet tubes 651, 652, 653, and 654 may be connected to each other by, for example, a three-way valve 173.

Thus, the water of the common water outlet tube 651, 652, 653, and 654 may flow through one of the first water outlet tube 171 and the second water outlet tube 172 by the three-way valve 173.

The common water outlet tubes 651, 652, 653, and 654 may be connected to the outlet tubes of the indoor heat exchangers 61*a*, 62*a*, 63*a*, and 64*a*, respectively.

First water inlet tubes 165*a*, 165*b*, 165*c*, and 165*d* through which water to be introduced into each indoor heat exchanger 61*a*, 62*a*, 63*a*, and 64*a* flows may be connected to the third combination tube 183.

A second water inlet tube 167*d* through which water to be introduced into each of the indoor heat exchangers 61*a*, 62*a*, 63*a*, and 64*a* flows may be connected to the fourth combination tube 184.

The first water inlet tubes 165*a*, 165*b*, 165*c*, and 165*d* and the second water inlet tube 167*d* may be arranged in parallel to each other and be connected to the common inlet tubes 611, 621, 631, and 641 communicating with the indoor heat exchangers 61*a*, 62*a*, 63*a*, and 64*a*.

Each of the first water inlet tubes 165*a*, 165*b*, 165*c*, and 165*d* may be provided with a first valve 166, and the second water inlet tubes 167*d* may be provided with a second valve 167.

An operation in which all the operation modes of the plurality of indoor units 61, 62, 63 and 64 are the same is referred to as an "exclusive operation". The dedicated operation may be understood as a case in which the indoor heat exchangers 61*a*, 62*a*, 63*a*, and 64*a* of the plurality of indoor units 61, 62, 63, and 64 operate only as the evaporators or as the condensers. Here, the plurality of indoor heat exchangers 61*a*, 62*a*, 63*a*, and 64*a* may be based on an operating (ON) heat exchanger rather than a stopped (OFF) heat exchanger.

Also, the operations of the plurality of indoor units 61, 62, 63, 64 in different operation modes are referred to as a "simultaneous operation". The simultaneous operation may be understood as a case in which some of the plurality of indoor heat exchangers 61*a*, 62*a*, 63*a*, and 64*a* operate as the condenser, and the remaining indoor heat exchangers operate as the evaporator.

Figure 4:
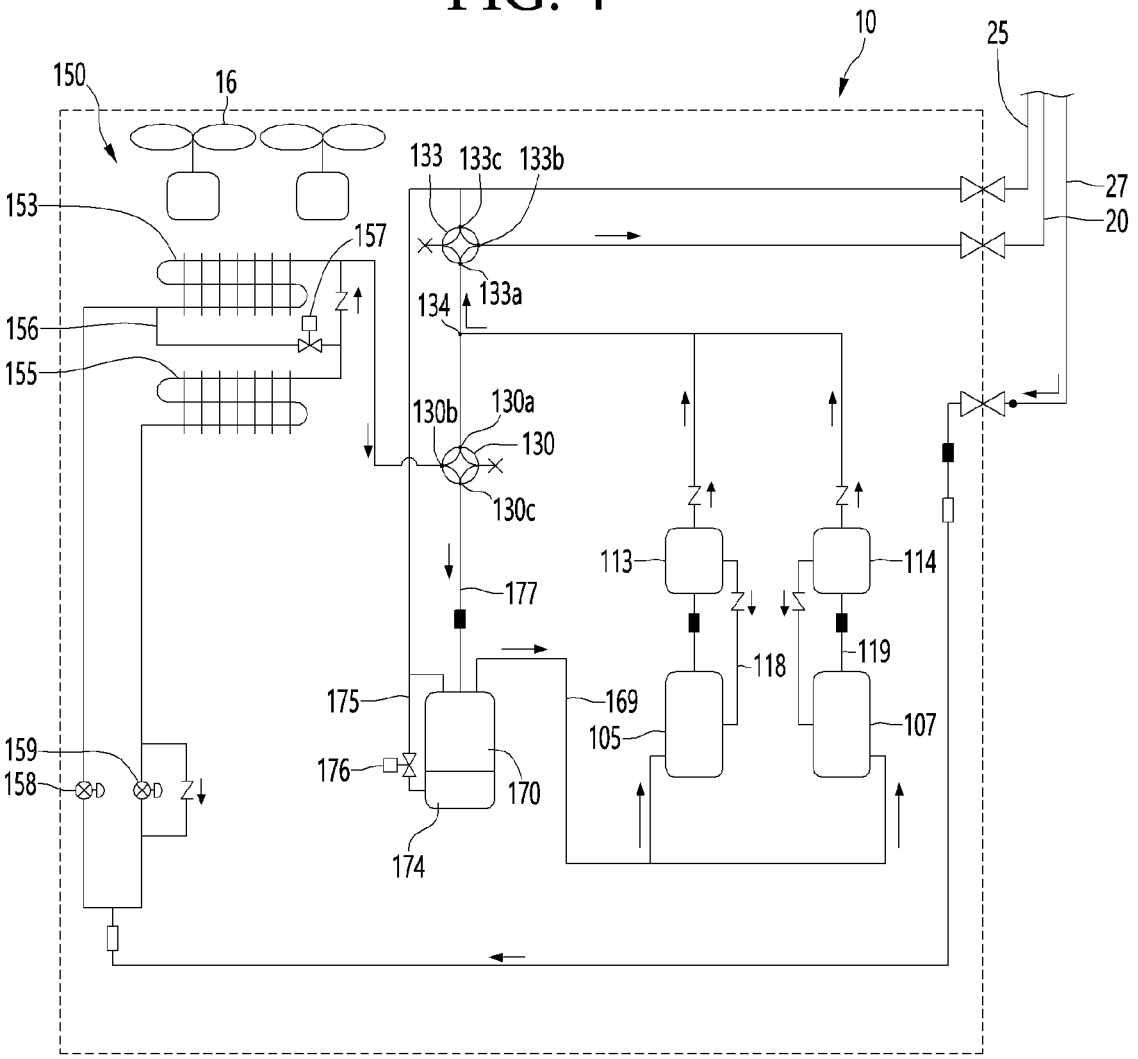
FIG. 4 is a cycle diagram illustrating a flow of a refrigerant in an outdoor unit during a heating operation of an indoor unit according to an embodiment.
Figure 5:
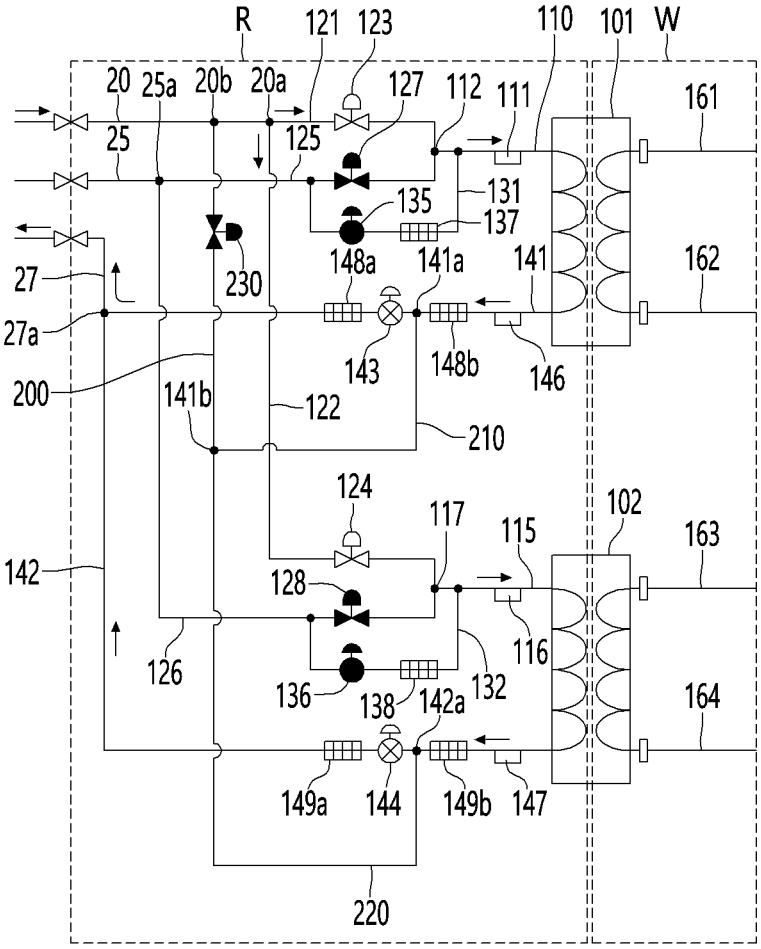
FIG. 5 is a cycle diagram illustrating a flow of the refrigerant in a heat exchange device during the heating operation of the indoor unit according to an embodiment.

FIG. 4 is a cycle diagram illustrating a flow of the refrigerant in the outdoor unit during the heating operation of the indoor unit according to an embodiment, and FIG. 5 is a cycle diagram illustrating a flow of the refrigerant in the heat exchange device during the heating operation of the indoor unit according to an embodiment.

Referring to FIGS. 4 and 5, when the air conditioning apparatus 1 performs the heating operation (when a number of indoor units perform the heating operation), the high-temperature gas refrigerant compressed in the compressors 105 and 107 of the outdoor unit 10 is introduced into the first port 133*a* of the second valve device 133. After being discharged to the second port 133*b*, the refrigerant is introduced into the heat exchange device 100 through the high-pressure gas tube 20.

The refrigerant introduced into the high-pressure gas tube 20 is introduced into the first refrigerant tube 110 and the second refrigerant tube 115 through the first high-pressure guide tube 121 and the second high-pressure guide tube 122. Here, the first high-pressure valve 123 and the second high-pressure valve 124 are opened, and the first low-pressure valve 127, the second low-pressure valve 128, and the bypass valve 230 are closed.

The compressed refrigerant introduced into the first refrigerant tube 110 and the second refrigerant tube 115 may be introduced into the first heat exchanger 101 and the second heat exchanger 102 and then be condensed by being heat-exchanged with water.

Here, the water absorbing heat of the refrigerant may be circulated through the indoor units 61, 62, 63, and 64, which require the heating operation.

The condensed refrigerant passing through the first heat exchanger 101 and the second heat exchanger 102 may flow to the liquid tube branch point 27*a* through the first liquid guide tube 141 and the second liquid guide tube 142.

In this process, the condensed refrigerant may be expanded while passing through the first flow valve 143 and the second flow valve 144. Also, the expanded refrigerant may be combined with each other at the liquid tube branch point 27*a* and then introduced into the outdoor unit 10 through the liquid tube 27.

The expanded refrigerant introduced into the outdoor unit 10 is evaporated in the outdoor heat exchanger 150 of the outdoor unit 10 to flow to the second port 130*b* of the first valve device 130. Then, the refrigerant is discharged to the third port 130*c* of the first expansion device 130 to flow through the low-pressure passage 177.

Also, the refrigerant in the low-pressure passage 177 may be introduced into the gas-liquid separator 160 and then be suctioned into the compressors 105 and 107 through the suction passage 169. This refrigerant cycle may be circulated.

The air conditioning apparatus 1 may perform the cooling operation.

For example, when the air conditioning apparatus 1 performs the cooling operation (when a number of indoor units perform the cooling operation), the high-temperature gas refrigerant compressed in the compressors 105 and 107 of the outdoor unit 10 is introduced into the first port 130*a* of the second valve device 130. Also, the refrigerant discharged to the second port 130*b* is condensed in the outdoor heat exchanger 150, and the condensed refrigerant is introduced into the heat exchanger 100 through the liquid tube 27.

The refrigerant introduced into the liquid tube 27 may be expanded while passing through the first flow valve 143 and the second flow valve 144 provided in the first liquid tube 141 and the second liquid tube 142, and then the refrigerant may be evaporated in the first heat exchanger 101 and the second heat exchanger 102.

The evaporated refrigerant passes through the first low-pressure valve 127 and the second low-pressure valve 128, which are provided in the first low-pressure guide tube 125 and the second low-pressure guide tube 126, to flow to the low-pressure gas tube 25. Also, the refrigerant of the low-pressure gas tube 25 may be introduced into the outdoor unit 10 and suctioned into the compressors 105 and 107 through the gas-liquid separator 170.

Here, the first low-pressure valve 127 and the second low-pressure valve 128 are opened, and the first high-pressure valve 123, the second high-pressure valve 124, and the bypass valve 230 are closed.

In addition, the air conditioning apparatus 1 may operate as the simultaneous operation in which the cooling operation and the heating operation are performed simultaneously. For example, the first heat exchanger 101 may function as the evaporator, and the second heat exchanger 102 may function as the condenser.

According to an embodiment, when the air conditioning apparatus 1 performs the simultaneous operation (some of the plurality of indoor units performs the cooling operation, and others perform the heating operation), the high-temperature gas refrigerant compressed in the compressors 105 and 107 passes through the second valve device 133 and then is introduced into the heat exchange device 100 via the high-pressure gas tube 20.

The refrigerant introduced into the high-pressure gas tube 20 is introduced into the first refrigerant tube 110 through the first high-pressure guide tube 121. Here, the first high-pressure valve 123 is opened, and the first low-pressure valve 127 is closed.

The refrigerant introduced into the first refrigerant tube 110 may be introduced into the first heat exchanger 101 and may be condensed by being heat-exchanged with water.

Here, the water absorbing heat of the refrigerant may be circulated through the indoor unit requiring the heating operation.

The condensed refrigerant discharged from the first heat exchanger 101 may flow to the liquid tube branch point 27*a* through the first liquid guide tube 141. Also, the condensed refrigerant may be expanded while flowing to the second liquid guide tube 142 and passing through the second flow valve 144.

The expanded refrigerant passing through the second flow valve 144 may be evaporated by being heat-exchanged with the water while passing through the second heat exchanger 102.

Here, the water cooled by the heat-exchange with the refrigerant may be circulated through the indoor unit requiring the cooling operation.

The evaporated refrigerant discharged from the second heat exchanger 102 may flow to the second low-pressure guide tube 126 through the second refrigerant tube 115.

Here, the second low-pressure valve 128 is opened, and the second high-pressure valve 124 is closed.

Also, the evaporated refrigerant flowing through the second low-pressure guide tube 126 may be introduced into the low-pressure gas tube 25 and suctioned into the compressors 105 and 107 of the outdoor unit 10.

As described above, the air conditioning apparatus 1 has the advantage of enabling all of the cooling operation, the heating operation, and the simultaneous operation through the control of the two valve devices 130 and 133 provided in the outdoor unit 10.

Figure 6:
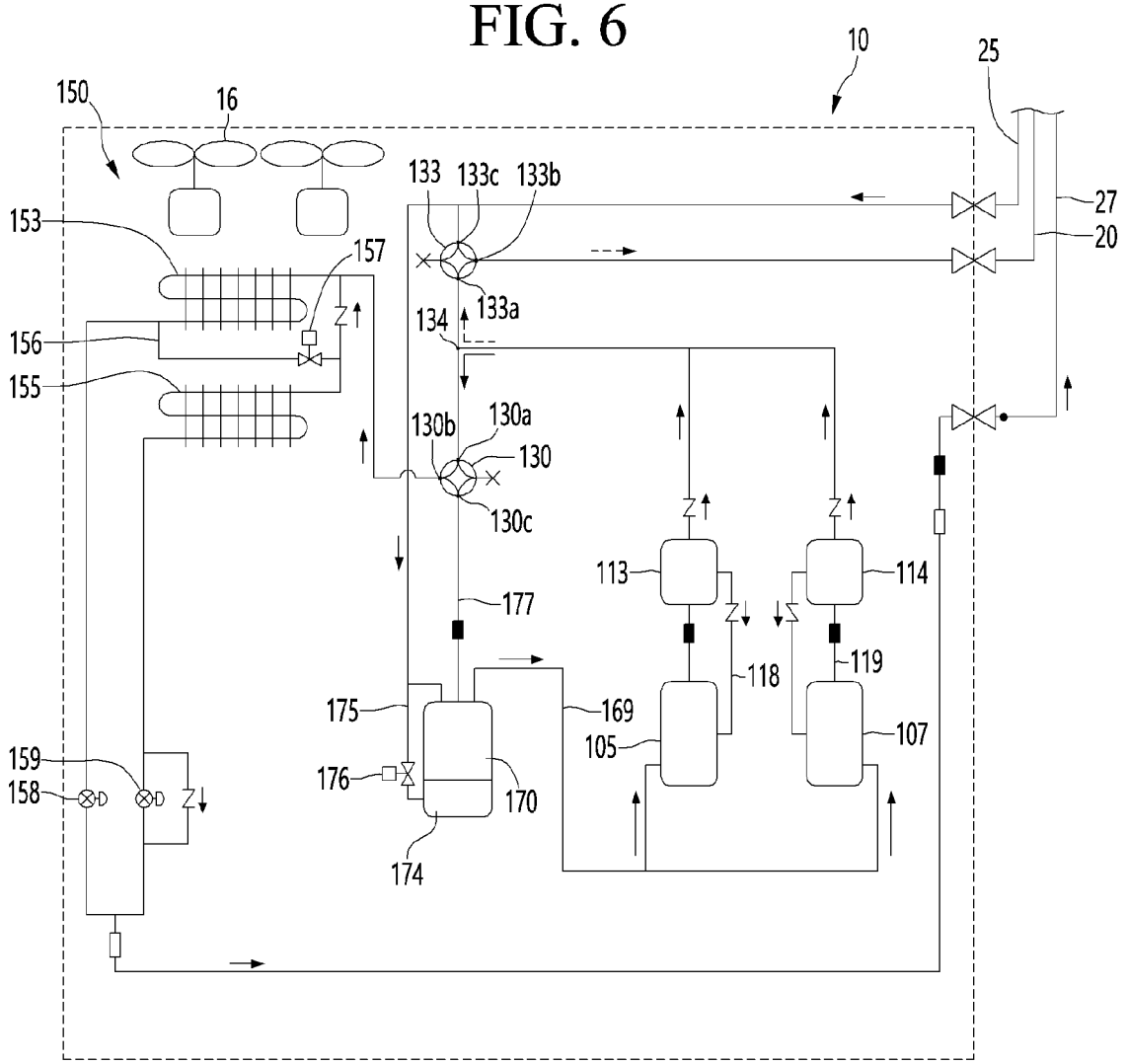
FIG. 6 is a cycle diagram illustrating a flow of the refrigerant in the outdoor unit during a defrosting operation according to an embodiment.
Figure 7:
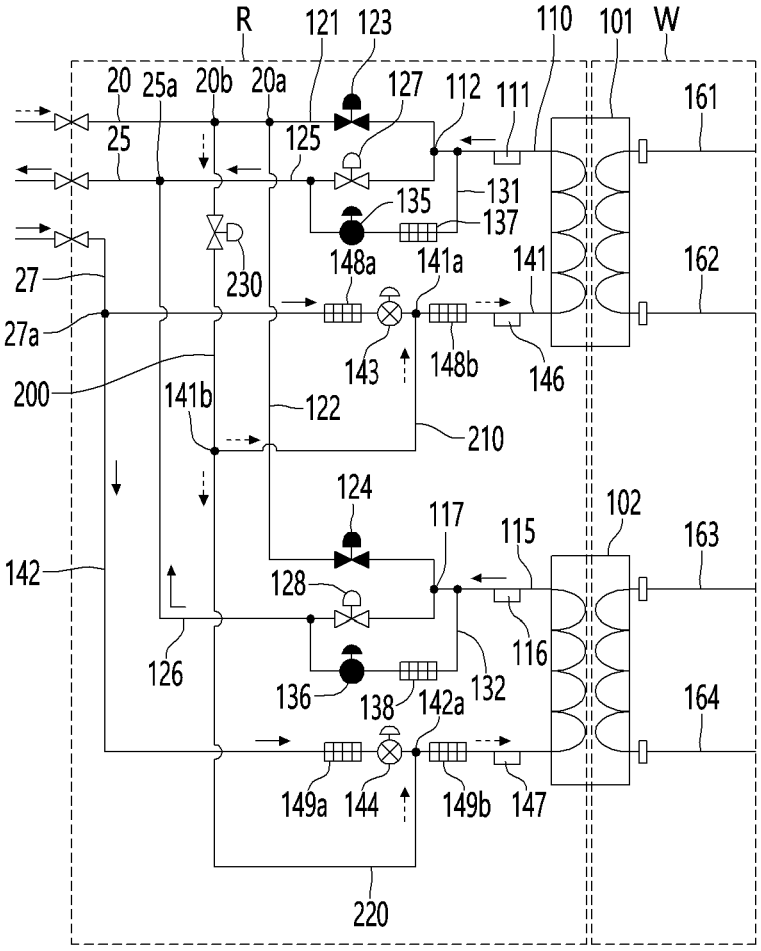
FIG. 7 is a cycle diagram illustrating a flow of the refrigerant in the heat exchange device during the defrosting operation according to an embodiment.

FIG. 6 is a cycle diagram illustrating a flow of the refrigerant in the outdoor unit during the defrosting operation according to an embodiment, and FIG. 7 is a cycle diagram illustrating a flow of the refrigerant in the heat exchange device during the defrosting operation according to an embodiment.

Referring to FIGS. 6 and 7, the air conditioning apparatus 1 may perform the defrosting operation while performing the heating operation of the indoor unit.

Here, the "defrosting operation" may be understood as a mode in which the refrigeration cycle operates as a reverse cycle (i.e., the cooling operation) for a certain time period so as to remove condensed water or frozen water, which is generated on the outdoor heat exchanger 150 during the heating operation of the indoor unit.

Specifically, when the defrosting operation is performed, a portion of the high-temperature gas refrigerant compressed in the compressors 105 and 107 of the outdoor unit 10 may be introduced into the first port 130*a* of the first valve device 130. The refrigerant introduced into the first port 130*a* is discharged to the second port 130*b* and condensed in the outdoor heat exchanger 150.

The high-temperature high-pressure gas refrigerant removes the condensed water or frozen water generated on the outdoor heat exchanger 150 while passing through the outdoor heat exchanger 150.

The refrigerant condensed in the outdoor heat exchanger 150 is introduced into the heat exchange device 100 through the liquid tube 27.

A portion of the refrigerant introduced into the liquid tube 27 is branched at the liquid tube branch point 27*a* to flow into the first liquid guide tube 141, and the other portion of the refrigerant is branched at the liquid tube branch point 27*a* to flow into the second liquid guide tube 142.

The condensed refrigerant introduced into the first liquid guide tube 141 and the second liquid guide tube 142 may be expanded while passing through the first flow valve 143 and the second flow valve 144. Also, the expanded refrigerant may absorb heat of the water and then be evaporated while passing through the first heat exchanger 101 and the second heat exchanger 102.

The evaporated refrigerant discharged from the first heat exchanger 101 and the second heat exchanger 102 may be introduced into the first low-pressure guide tube 125 and the second low-pressure guide tube 126 to flow to the low-pressure tube 25.

Here, the first low-pressure valve 127 and the second low-pressure valve 128 are opened, and the first high-pressure valve 123 and the second high-pressure valve 124 are closed.

The refrigerant introduced into the low-pressure gas tube 25 may be suctioned into the compressors 105 and 107 via the gas-liquid separator 10 of the outdoor unit 10.

The remaining refrigerant of the high-temperature gas refrigerant compressed in the compressors 105 and 107 of the outdoor unit 10 is introduced into the first port 133*a* of the second valve device 133. The refrigerant introduced through the first port 133*a* is discharged to the second port 133*b* and then introduced into the heat exchanger 100 through the high-pressure gas tube 20.

The high-temperature high-pressure refrigerant introduced into the heat exchange device 100 is branched at the first bypass branch point 20*b* of the high-pressure gas tube 20 to flow into the bypass tubes 200, 210, and 220.

Here, since the first high-pressure valve 123 and the second high-pressure valve 124 are in the closed state, and the bypass valve 230 is in the opened state, the refrigerant of the high-pressure gas tube 20 may flow to the pass tubes 200, 210, and 220.

In detail, the refrigerant of the high-pressure gas tube 20 may be introduced into the common tube 200 and then branched from the second bypass branch point 141*b* to flow to the first bypass tube 210 and the second bypass tube 220.

Also, the high-temperature high-pressure refrigerant passing through the first bypass tube 210 and the second bypass tube 220 may flow through the refrigerant passages of the first heat exchanger 101 and the second heat exchanger 102 to prevent the heat exchanger from being frozen to burst.

That is, when the defrosting operation is started, a portion (referred to as a "hot gas") of the high-temperature high-pressure refrigerant compressed in the compressors 105 and 107 may be injected into the heat exchangers 101 and 102 through the bypass tubes 200, 210, and 230 to significantly reduce possibility of the freeing and rupturing of the heat exchanger.

In this embodiment, only the first heat exchanger 101 may be used without using the second heat exchanger 102.

In this case, the first high-pressure valve 123 corresponding to the first heat exchanger 101 may be closed, and the first low-pressure valve 127 and the first flow valve 143 may be opened.

On the other hand, all the second high-pressure valve 124 corresponding to the second heat exchanger 101, the second low-pressure valve 128, and the second flow valve 144 may be closed. As a result, the refrigerant of the high-pressure gas tube 20 may pass only the first heat exchanger 101 through the first flow valve 143.

According to this configuration, even if the refrigerant leak occurs in the second flow valve 144, since all of rear ends of the second heat exchanger 102 are blocked, the refrigerant flow does not occur. That is to say, even if a small amount of refrigerant is introduced into the second heat exchanger 102 through the second flow valve 144, the second low-pressure valve 124, the second high-pressure valve 128, and the second pressure equalization valve 136 are closed, the refrigerant flow may be completely blocked.

Figure 8:
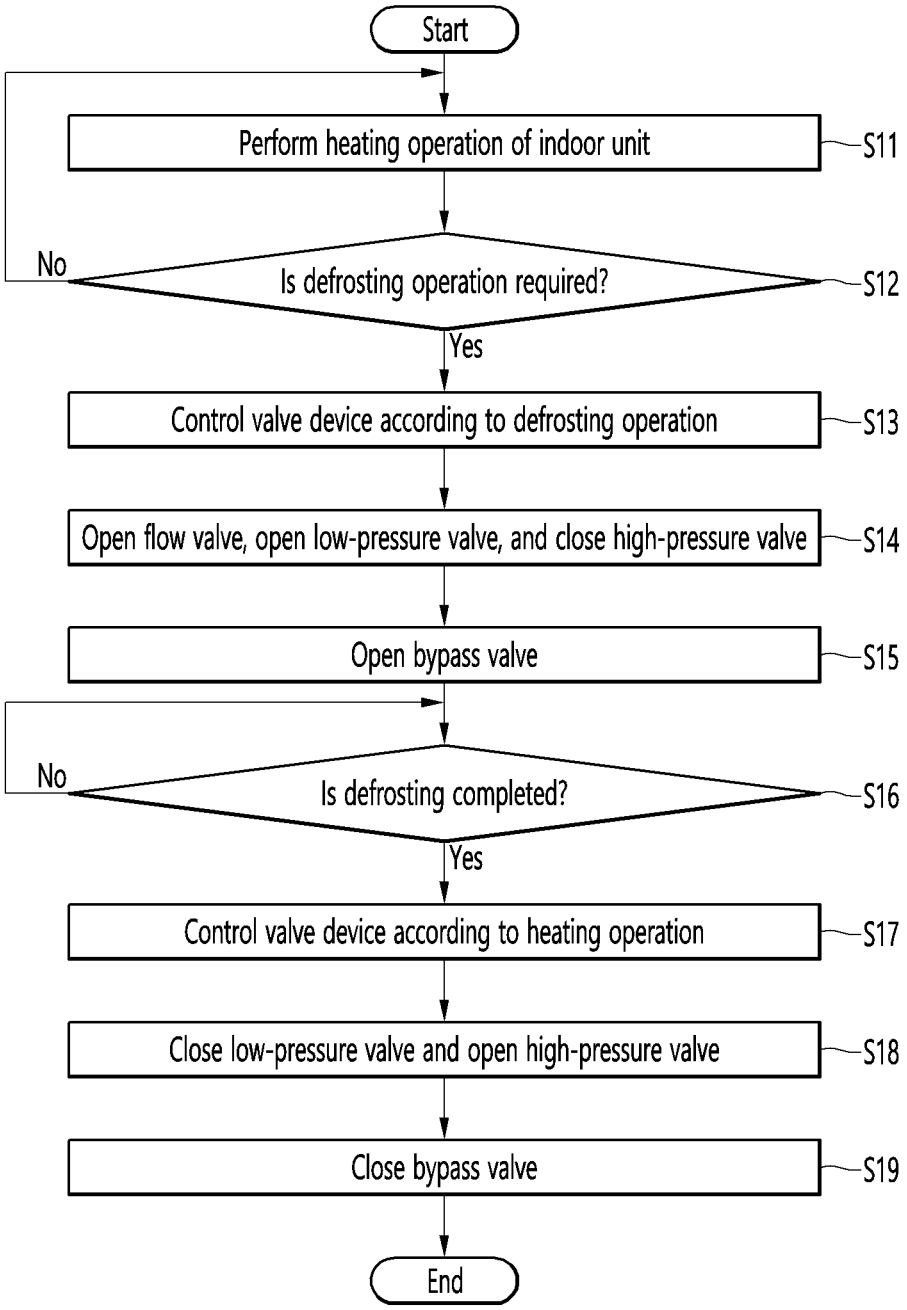
FIG. 8 is a flowchart illustrating a method for controlling an air conditioning apparatus according to an embodiment.

FIG. 8 is a flowchart illustrating a method for controlling an air conditioning apparatus according to an embodiment.

Referring to FIG. 8, in operation S11, an air conditioning apparatus 1 performs a heating operation of an indoor unit.

For example, an occupant may input a heating mode by driving at least one of a plurality of indoor units 60.

Here, the occupant's input may be performed by various input units. For example, each of the input units may include an input portion provided in the air conditioning apparatus 1 or various communication devices such as a remote control or a mobile phone.

When the heating operation of the indoor unit is performed, the air conditioning apparatus 1 drives compressors 105 and 107 provided in an outdoor unit 10, and a second port 130*b* and a third port 130*c* of a first valve device 130 and a first port 133*a* and a second port 133*b* of a second valve device 133 are opened.

Also, the air conditioning apparatus 1 opens a first high-pressure valve 123, a second high-pressure valve 124, a first flow valve 143, and a second flow valve 144, which are provided in the heat exchange device 100. Here, a first low-pressure valve 127, a second low-pressure valve 128, and a bypass valve 230 are closed.

Thus, a refrigerant compressed in the compressors 105 and 107 may pass through the second valve device 133 to pass through the first high-pressure valve 123 and the second high-pressure valve 124 and then be condensed in a first heat exchanger 101 and a second heat exchanger 102.

Also, the condensed refrigerant may be expanded while passing through the first flow valve 143 and the second flow valve 144, and the expanded refrigerant may be evaporated in an outdoor heat exchanger 150.

The evaporated refrigerant may be suctioned into the compressors 105 and 107 through the first valve device 130. That is, each of the first heat exchanger 101 and the second heat exchanger 102 function as a condenser, and the outdoor heat exchanger 150 functions as an evaporator.

In operation S12, the air conditioning apparatus 1 determines whether a defrosting operation is required.

Specifically, in case of winter at which a temperature of external air is low, when a heating operation is performed, condensed water generated on a surface of an outdoor heat exchanger may be frozen. In this case, a smooth flow of outdoor air and heat exchange are disturbed to cause deterioration of heating performance.

Thus, to remove the condensed water or the freezing, a defrosting operation in which the heating operation is stopped during the heating operation, and a refrigeration cycle operates in a reverse cycle (i.e., a cooling operation) may be performed. As a result, a high-temperature high-pressure refrigerant passes through the outdoor heat exchanger, and the frozen water of the surface of the outdoor heat exchanger may be melted by heat of the refrigerant.

Thus, the air conditioning apparatus 1 may perform the defrosting operation at a specific time or at a predetermined time interval.

If it is determined that the defrosting operation is required, the air conditioning apparatus 1 controls a valve device according to the defrosting operation in operation S13, opens the flow valve and the low-pressure valve in operation S14, and opens the bypass valve in operation S15.

Specifically, when it is determined that the defrosting operation is required, the air conditioning apparatus 1 may convert a refrigerant cycle into a reverse cycle (i.e., cooling operation).

That is, the air conditioning apparatus 1 opens a first port 130*a* and a second port 130*b* of the first valve device 130 and a first port 133*a* and a second port 133*b* of the second valve device 133.

Also, the air conditioning apparatus 1 opens the first low-pressure valve 127, the second low-pressure valve 128, the first flow valve 143, and the second flow valve 144, which are provided in the heat exchange device 100. In addition, the air conditioning apparatus 1 opens the bypass valve 230 provided in each of the bypass tubes 200, 210, and 220. Here, the first high-pressure valve 123 and the second high-pressure valve 124 are closed.

Thus, a portion of the refrigerant compressed in the compressors 105 and 107 are condensed in the outdoor heat exchanger 150 via the first valve device 130, and the condensed refrigerant is introduced into the heat exchange device 100 through the liquid tube 27.

Also, the refrigerant introduced into the heat exchange device 100 may be expanded while passing through the first flow valve 143 and the second flow valve 144, and the expanded refrigerant may be evaporated in the first heat exchanger 101 and the second heat exchanger 102. The evaporated refrigerant passes through the first low-pressure valve 127 and the second low-pressure valve 128 to flow to the outdoor unit 10.

The evaporated refrigerant introduced into the outdoor unit 10 may be suctioned into the compressors 105 and 107 via a gas-liquid separator 170. That is, each of the first heat exchanger 101 and the second heat exchanger 102 may function as the evaporator, and the outdoor heat exchanger 150 may perform the defrosting operation to function as the condenser.

A portion of the remaining refrigerant compressed in the compressors 105 and 107 are introduced into the heat exchange device 100 through the high-pressure gas tube 20 via the second valve device 133.

The high-temperature high-pressure refrigerant introduced into the heat exchange device 100 is introduced into the common tube 200 of the bypass tube through a first bypass branch point 20*b* defined in the high-pressure gas tube 20. Also, the refrigerant introduced into the common tube 200 is branched at a second bypass branch point 141*b* to flow to the first bypass tube 210 and the second bypass tube 220.

The high-temperature high-pressure refrigerant flowing through the first bypass tube 210 may pass through the first heat exchanger 101 to increase in temperature of the first heat exchanger 101, thereby preventing the first heat exchanger 101 from being frozen to burst.

Also, the high-temperature high-pressure refrigerant flowing through the second bypass tube 220 may pass through the second heat exchanger 102 to increase in temperature of the second heat exchanger 102, thereby preventing the first heat exchanger 102 from being frozen to burst.

In operation S16, the air conditioning apparatus 1 determines whether the defrosting is completed.

For example, as described above, the air conditioning apparatus 1 may continue the defrosting operation for a predetermined time. Alternatively, the air conditioning apparatus 1 may determine a defrost completion time point based on a temperature detected by a defrost temperature sensor (not shown) provided in the outdoor heat exchanger 150.

If it is determined that the defrosting is complete, the air conditioning apparatus 1 controls the valve device according to the heating operation in operation S17, closes the low-pressure valve and opens the high-pressure valve in operation S18, and closes the bypass valve in operation S19.

That is, the air conditioning apparatus 1 opens a second port 130*b* and a third port 130*c* of the first valve device 130 and the first port 133*a* and the second port 133*b* of the second valve device 133.

Also, the air conditioning apparatus 1 opens the first high-pressure valve 123, the second high-pressure valve 124, the first flow valve 143, and the second flow valve 144, which are provided in the heat exchange device 100 and closes the first low-pressure valve 127, the second low-pressure valve 128, and the bypass valve 230.

Thus, the refrigerant is circulated through the heating operation cycle of the indoor unit, and thus, each of the first heat exchanger 101 and the second heat exchanger 102 function as the condenser, and the outdoor heat exchanger 150 functions as the evaporator.

According to the air conditioning apparatus according to the embodiment having the above configuration has the following effects.

First, when the air conditioning apparatus performs the defrosting operation, the heat exchanger in which the refrigerant and the water are heat-exchanged with each other may be prevented from being frozen to burst.

Particularly, when the defrosting operation is started during the heating operation, since the high-temperature refrigerant of the high-pressure gas tube is introduced into the heat exchanger through the liquid guide tube via the bypass tube connecting the high-pressure gas tube to the liquid guide tube, the internal temperature of the heat exchanger may increase due to the high-temperature refrigerant.

Second, since the outdoor unit is provided with the two valve devices that control the flow direction of the refrigerant, the cooling operation and the heating operation of the indoor unit may be performed at the same time, and also the cooling operation or the heating operation may be switchable.

Third, even when only some of the plurality of heat exchangers are used, the heat exchanger may be prevented from being frozen to burst.

Fourth, even if the refrigerant leaks to the unused heat exchanger, the flow of refrigerant in the heat exchanger may be completely blocked.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioning apparatus comprising:

an outdoor unit which comprises a compressor and an outdoor heat exchanger and through which a refrigerant is circulated;

an indoor unit through which water is circulated; and a heat exchange device comprising a heat exchanger in which the refrigerant and the water are heat-exchanged with each other, wherein the heat exchange device comprises:

a high-pressure guide tube extending from a high-pressure gas tube of the outdoor unit so as to be connected to one side of the heat exchanger;

a low-pressure guide tube extending from a low-pressure gas tube of the outdoor unit so as to be combined with the high-pressure guide tube;

a liquid guide tube extending from a liquid tube of the outdoor unit so as to be connected to another side of the heat exchanger;

a bypass tube configured to connect a first bypass branch point of the high-pressure gas tube to a first bypass combination point of the liquid guide tube to bypass a high-pressure refrigerant existing in the high-pressure tube to the liquid guide tube; and a bypass valve installed in the bypass tube, wherein the outdoor unit further comprises:

a first valve device configured to guide the refrigerant compressed in the compressor to the outdoor heat exchanger; and a second valve device configured to guide the refrigerant compressed in the compressor to the high-pressure guide tube of the heat exchange device.

2. The air conditioning apparatus according to claim 1, wherein the bypass valve comprises a solenoid valve that is capable of being opened and closed.

3. The air conditioning apparatus according to claim 1, wherein, when the outdoor heat exchanger performs a defrosting operation, the bypass valve is opened to bypass the high-pressure refrigerant of the high-pressure gas tube to the liquid guide tube.

4. The air conditioning apparatus according to claim 1, wherein, when the indoor unit performs a cooling or heating operation, the bypass valve is closed to restrict the bypassing of the high-pressure refrigerant of the high-pressure gas tube to the liquid guide tube.

5. The air conditioning apparatus according to claim 1, wherein, when the indoor unit performs a cooling operation, the refrigerant compressed in the compressor is condensed in the outdoor heat exchanger via the first valve device, and the condensed refrigerant is evaporated in the heat exchanger of the heat exchange device.

6. The air conditioning apparatus according to claim 1, wherein, when the indoor unit performs a heating operation, the refrigerant compressed in the compressor is condensed in the heat exchanger of the heat exchange device via the second valve device, and the condensed refrigerant is evaporated in the outdoor heat exchanger and suctioned into the compressor via the first valve device.

7. The air conditioning apparatus according to claim 1, further comprising:

a high-pressure valve installed in the high-pressure guide tube, the high-pressure valve being configured to be opened and closed;

a low-pressure valve installed in the low-pressure guide tube, the low-pressure valve being configured to be opened and closed; and a flow valve installed in the liquid guide tube to control a flow rate of the refrigerant.

8. The air conditioning apparatus according to claim 7, wherein the bypass combination point is defined at a point between the heat exchanger and the flow valve.

9. The air conditioning apparatus according to claim 7, wherein, when the outdoor heat exchanger performs a defrosting operation, the low-pressure valve, the flow valve, and the bypass valve are opened, and the high-pressure valve is closed.

10. The air conditioning apparatus according to claim 9, wherein, when the outdoor heat exchanger performs the defrosting operation, a portion of the refrigerant compressed in the compressor flows to the outdoor heat exchanger through the first valve device, and a remaining portion of the refrigerant compressed in the compressor flows to the bypass tube through the second valve device.

11. The air conditioning apparatus according to claim 7, wherein the heat exchanger comprises a first heat exchanger and a second heat exchanger, the high-pressure guide tube comprises:

a first high-pressure guide tube extending from the high-pressure gas tube of the outdoor unit so as to be connected to one side of the first heat exchanger; and a second high-pressure guide tube extending from the high-pressure gas tube of the outdoor unit so as to be connected to one side of the second heat exchanger, and the liquid guide tube comprises:

a first liquid guide tube extending from the liquid tube of the outdoor unit so as to be connected to another side of the first heat exchanger; and a second liquid guide tube extending from the liquid tube of the outdoor unit so as to be connected to another side of the second heat exchanger.

12. The air conditioning apparatus according to claim 11, wherein the bypass tube comprises:

a common tube branched from the first bypass branch point of the high-pressure gas tube;

a first bypass tube branched from a second bypass branch point of the common tube so as to be connected to the first bypass combination point of the first liquid guide tube; and a second bypass tube branched from the second bypass branch point of the common tube so as to be connected to a second bypass combination point of the second liquid guide tube.

13. The air conditioning apparatus according to claim 12, wherein the bypass valve is installed in the common tube.

14. An air conditioning apparatus comprising:

an outdoor unit which comprises a compressor and an outdoor heat exchanger and through which a refrigerant is circulated;

an indoor unit through which water is circulated; and a heat exchange device comprising a first heat exchanger and a second heat exchanger, in which the refrigerant and the water are heat-exchanged with each other, wherein the heat exchange device comprises:

a first high-pressure guide tube extending from a high-pressure gas tube of the outdoor unit so as to be connected to one side of the first heat exchanger;

a second high-pressure guide tube extending from the high-pressure gas tube of the outdoor unit so as to be connected to one side of the second heat exchanger;

a first low-pressure guide tube extending from a low-pressure gas tube of the outdoor unit so as to be combined with the first high-pressure guide tube;

a second low-pressure guide tube extending from the low-pressure gas tube of the outdoor unit so as to be combined with the second high-pressure guide tube;

a first liquid guide tube extending from a liquid tube of the outdoor unit so as to be connected to another side of the first heat exchanger;

a second liquid guide tube extending from the liquid tube of the outdoor unit so as to be connected to another side of the second heat exchanger;

a bypass tube configured to bypass a high-pressure refrigerant of the high-pressure gas tube to the first liquid guide tube or the second liquid guide tube; and a bypass valve installed in the bypass tube, wherein the outdoor unit comprises:

a first valve device configured to guide the refrigerant compressed in the compressor to the outdoor heat exchanger; and a second valve device configured to the refrigerant compressed in the compressor to the first high-pressure guide tube or the second high-pressure guide tube.

15. The air conditioning apparatus according to claim 14, wherein the bypass valve comprises a solenoid valve that is capable of being opened and closed.

16. The air conditioning apparatus according to claim 14, wherein, when the outdoor heat exchanger performs a defrosting operation, the bypass valve is opened to bypass the high-pressure refrigerant of the high-pressure gas tube to the first liquid guide tube and the second liquid guide tube.

17. The air conditioning apparatus according to claim 14, wherein the bypass tube comprises:

a common tube branched from a first bypass branch point of the high-pressure gas tube;

a first bypass tube branched from a second bypass branch point of the common tube so as to be connected to a first bypass combination point of the first liquid guide tube; and a second bypass tube branched from the second bypass branch point of the common tube so as to be connected to a second bypass combination point of the second liquid guide tube, wherein the bypass valve is installed in the common tube.

18. The air conditioning apparatus according to claim 17, wherein the first bypass combination point is defined at a point between the first heat exchanger and a first flow valve, and the second bypass combination point is defined at a point between the second heat exchanger and a second flow valve.

19. The air conditioning apparatus according to claim 17, further comprising:

a first high-pressure valve and a second high-pressure valve, which are installed in the first high-pressure guide tube and the second high-pressure guide tube, respectively;

a first low-pressure valve and a second low-pressure valve, which are installed in the first low-pressure guide tube and the second low-pressure guide tube, respectively; and a first flow valve and a second flow valve, which are installed in the first liquid guide tube and the second liquid guide tube, respectively.

20. The air conditioning apparatus according to claim 19, wherein, when the outdoor heat exchanger performs a defrosting operation, the first and second low-pressure valves, the first and second flow valves, and the bypass valve are opened, and the first and second high-pressure valves are closed.

* * * * *